United States Patent [19]

Barrows

[11] 4,083,061

[45] Apr. 4, 1978

[54] PORTABLE DARKROOM

[76] Inventor: George H. Barrows, 1279 Bassett, Louisville, Ky. 40204

[21] Appl. No.: 680,147

[22] Filed: Apr. 26, 1976

[51] Int. Cl.[2] ..... G03D 17/00

[52] U.S. Cl. ..... 354/307

[58] Field of Search ..... 354/307, 308, 309

[56] References Cited

U.S. PATENT DOCUMENTS

| | | | |
|---|---|---|---|
| 1,032,728 | 7/1912 | Bajkay | 354/308 |
| 2,054,526 | 9/1936 | Sutcliffe | 354/309 X |
| 2,220,373 | 11/1940 | Krauser et al. | 354/307 X |
| 2,651,982 | 9/1953 | Weaver | 354/308 |
| 3,208,335 | 9/1965 | Doherty | 354/308 X |

*Primary Examiner*—Fred L. Braun

*Attorney, Agent, or Firm*—Wm. R. Price

[57] ABSTRACT

This invention involves a portable darkroom comprising a box having a light trap on one open side at the front in combination with a non-reflective surface on adjacent wall and floor portions to prevent reflected light from entering the opening of the light trap on the open side of the box. The interior of the box is coated with a nonreflective surface so as to exclude reflections of light within the box.

6 Claims, 7 Drawing Figures

PORTABLE DARKROOM

FIELD OF THE INVENTION

This invention relates to photographic materials and specifically to a photographic darkroom which is portable and which is open so as to prevent a feeling of suffocation or of claustrophobia.

BACKGROUND OF THE INVENTION

A darkroom is employed for photographic processing which necessitates utilization of a large amount of space for a limited purpose. For amateurs, the price of installing a darkroom is often prohibitive, thus limiting their processing to commercial labs or makeshift apparatus. There are current available closed systems which allow a photographer to load photographic materials in daylight. These, nevertheless, require darkened surroundings for the initial loading.

DESCRIPTION OF THE PRIOR ART

Portable photographic darkrooms have been proposed in the past. In all cases of which the inventor is aware, this type of apparatus has involved a hood or a curtained area which has a suffocating effect on many people and leads to claustrophobic feelings. Note, for example, the patents to: Robbins, U.S. Pat. No. 164,765; Walker, U.S. Pat. No. 312,937; Dunscomb, U.S. Pat. No. 684,803; Erickson, U.S. Pat. No. 823,465; Burr, et. al., U.S. Pat. No. 922,254; Oliver, U.S. Pat. No. 1,080,995; Leachman, U.S. Pat. No. 1,159,966. Note for example, that the patent to Leachman involves a hooded area with an opening 27, having a tube 28, secured to the side and leading to a mask 29 fitted over the head of the operator so as to allow the operator some fresh air while inside of the enclosure.

SUMMARY OF THE INVENTION

According to the present invention, there is provided a simple and inexpensive structure comprising a box, partially open at the front and containing a light trap defined by top and bottom baffles. The box is used in conjunction with a nonreflective surface which may be in the form of a flat black curtain or a flat black surface of any nature, in the surrounding or adjacent portions of the wall and floor. The exact area of the nonreflective surface on the adjacent wall and floor surfaces is dictated by the relationship of the top and bottom baffles. Further, the interior of the box is coated with a nonreflective surface which eliminates reflected light within the box itself. The invention is based upon the fact that light travels in a linear direction and is reflected in a linear direction. Thus, by the proper selection of baffles and by the proper selection of an area of nonreflective surface adjacent to the baffles, light can be eliminated from insie the darkroom area.

BRIEF DESCRIPTION OF THE DRAWINGS

Referring now to the drawings.

DESCRIPTION OF THE PREFERRED EMBODIMENT

Figure 5:
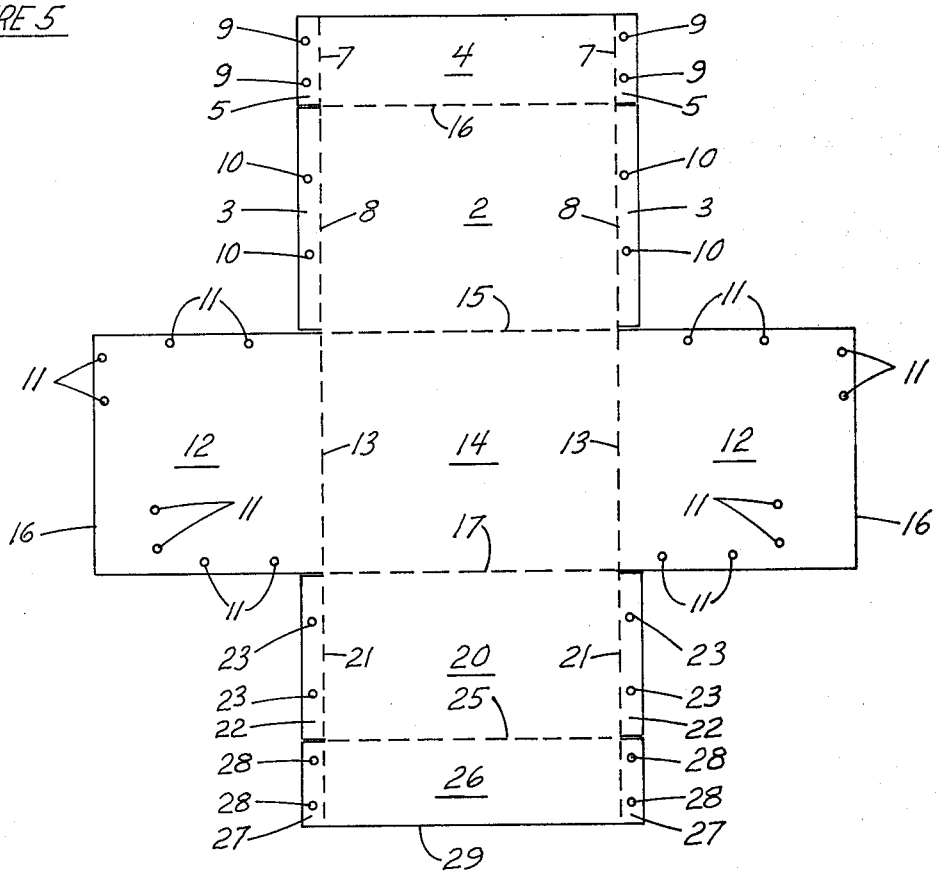
FIG. 5 is a plan view of a sheet metal blank which may be utilized in one embodiment of this invention for production of a portable darkroom.

Referring now to the drawings and particularly to FIG. 5 of the drawings, a blank for one embodiment of the invention is shown in detail. This comprises a top portion 2 having flange portions 3 which are folded along a fold line 7. The top baffle 4 is folded over along fold line 6 so that the bottom edge 4' of the top baffle 4 extends downwardly. Top baffle flanges 5 are folded over on fold lines 8 and contain bolt holes 9. Bolt holes 10 are contained in flange 3 of the top portion 2. These bolt holes are made to register with bolt holes 11 of side portions 12 of the blank. The back portion 14 is separated by fold lines 13 from the side portions 12 and by fold line 15 from the top portion 2. Fold line 17 separates the back portion 14 from the bottom portion 20 which is folded along lines 21 to form bottom flanges 22, containing bolt holes 23. Fold line 25 forms the bottom baffle 26 which contains bottom baffle flange 27 and bottom flange bolt holes 28. The edge of the bottom baffle is designated by number 29.

Figure 1:
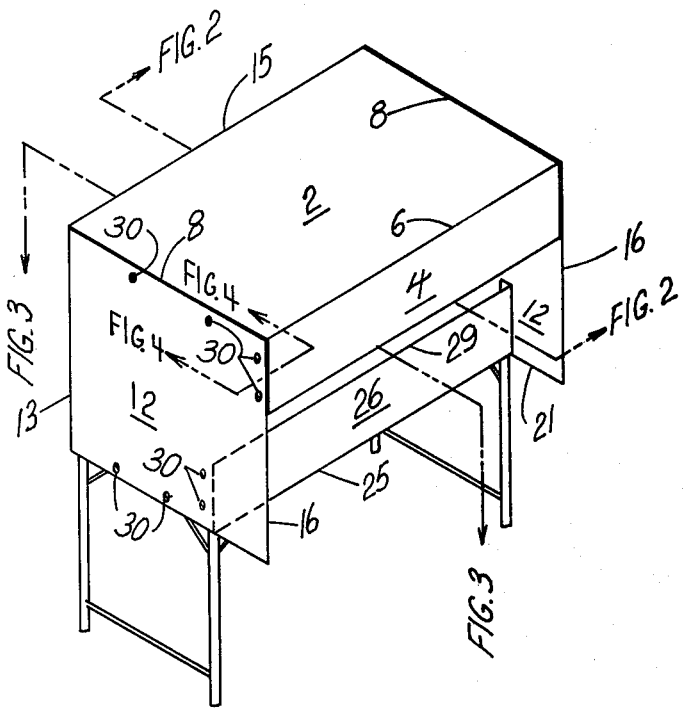
FIG. 1 is a view, in perspective, of the portable darkroom of this invention.
Figure 4:
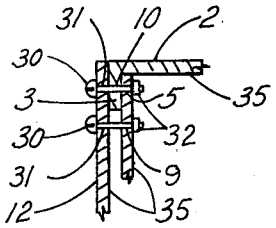
FIG. 4 is a view taken along lines 4—4 of FIG. 1, illustrating a light tight joint structure which may be utilized in one modification of this invention.

The blank, when placed into position, is shown in FIG. 1. Bolts containing bolt head 30, shank 31 and nut 32, are inserted through the holes of each part so as to register with each other as is shown in detail in FIG. 4. This is a sectional view, taken along line 4—4 of FIG. 1. If desired, a piece of tape or other material can be placed over the seams so as to insure a light tight joint along each edge.

Figure 2:
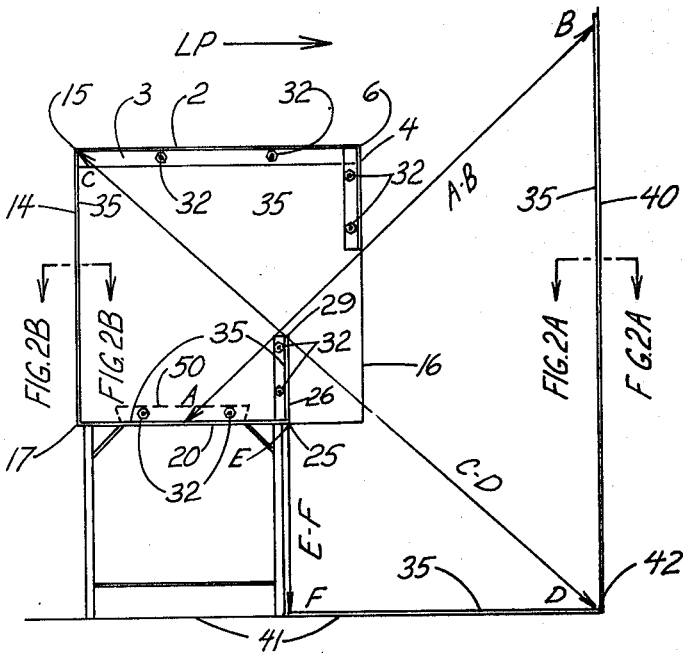
FIG. 2 is a sectional view, taken on line 2—2 of FIG. 1 and illustrating the relationship of the bottom and top baffles to the nonreflective surface on the wall and floor portions adjacent to said portable darkroom.
Figure 2A:
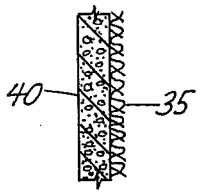
FIG. 2A is an exploded view taken along lines 2A—2A of FIG. 2.
Figure 2B:
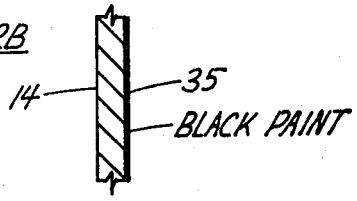
FIG. 2B is an exploded view taken along lines 2B—2B of FIG. 2.

The critical positioning, however, relates to the light trap in the front of the portable dark room 1, defined by the top baffle 4 and the bottom baffle 26. As is shown in FIG. 2, the entire interior surface of the portable darkroom is coated with a nonreflective surface 35. Any flat black nonreflective surface can be utilized. As illustrated in FIG. 2B, a coating of a flat black or matte finish paint is suitable. The purpose is, of course, to eliminate reflected light from within the portable darkroom from reflecting down into the photographic processing tray 50 indicated by phantom lines. The nonreflective surface 35 shown as a covering for wall 40 and floor 41 is illustrated in FIG. 2B as a black curtain. Again other nonreflective surfaces can be utilized. The required area of the nonreflective surface 35 draped over the wall 40 and the floor 41 is illustrated by rays A-B. This ray extends from point A at the bottom 20 of the portable darkroom 1 to point B, on the wall 40. Since light travels linearly as illustrated by light path LP, and is reflected linearly, any light reflected above that point will hit the front surface of the depending top baffle 4. Since the nonreflective surface 35 will intercept light rays and eliminate reflected light and since the light source LS is on the opposite side, facing the back 14 of the portable darkroom 1, direct light cannot enter. By the same token, Ray E-F, taken from point E at the fold line 25 of the bottom baffle 26 and extending vertically down to point F on the floor 41 will be intercepted by nonreflective surface 35. This eliminates any reflected light from reflecting vertically into the opening defined by baffles 4 and 26. The Ray C-D extending from point D at the juncture 42 of the floor 41 and wall 40, to point C at fold line 15 of the back 14 of the portable darkroom 1, illustrates that the light striking any place within the area defined by the horizontal and vertical areas covered by the curtain 35 will eliminate reflected light from entering.

Figure 3:
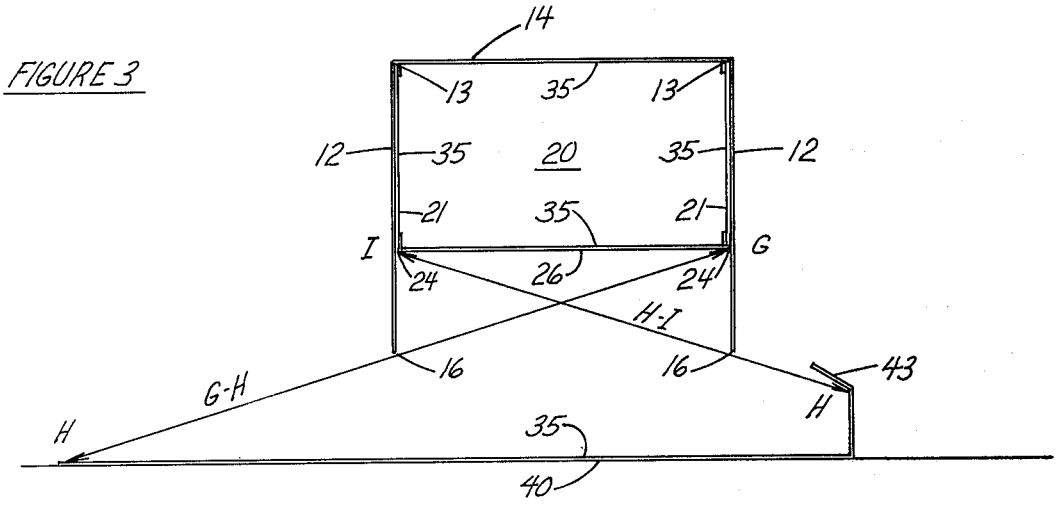
FIG. 3 is a sectional view taken along lines 3—3 of FIG. 1 illustrating the lateral extension of said nonreflective surface so as to intercept light rays and prevent them from entering said light trap from the side.

Referring now to FIG. 3, the lateral area necessarily covered by the nonreflective surface 35, is dictated by Ray G-H which extends from point G at juncture 24 between the bottom baffle 26 and side 12 of the box to point H which is a ray projected from point G to the edge 16 of the side 12 onto point H of wall surface 40. This surface can be shortened by provision of screen 43 placed parallel to the side portions 12 of the photographic darkroom 1 as is illustrated in FIG. 3. It is necessary that the nonreflective surface 35 intercept any light rays which might enter the light trap.

While a sheet metal construction has been shown, which in the drawings has been illustrated as covered with a nonreflective surface of black matte paint, other materials can be utilized. Thus, the box could be made of cardboard, hardboard, plywood or other materials. Hinges could be substituted for fold lines and could be made suitably lightproof by tape or other means. Therefore, the various sides could be folded down upon themselves for storage. The exact materials of fabrication and the method of construction are not particularly important so long as the particular relationship of the baffles to each other and to the nonreflective wall and floor surface are maintained. As shown in the drawing FIG. 2, my work has been with a box having side and back portions 4 feet in width and height and located 3 feet from the wall. I have found that with these dimensions bottom baffles 1¼feet high can be located anyplace from between 2 feet from the corner 17 of the box to 3 feet therefrom and provide sufficient room in the bottom of the darkroom and sufficient nonreflective surface so that the nonreflective surface 35 need not extend too high on the adjacent wall. This height arbitrarily has been set at about 9 feet. Of course, the curtain can be located higher if desired. Further, the floor portion is covered with a nonreflective surface or can be permanently painted with a nonreflective matte coat of black.

It is only necessary to situate the photographic darkroom 1 in such a position so that the back 14 is away from the light source LS and so that reflective wall and floor surfaces are covered with nonreflective matter so as to intercept light rays and prevent reflected light from entering the light trap opening defined by bottom baffle 26 and upper baffle 4 at the front of the box.

Many modifications will occur to those skilled in the art from the detailed description hereinabove given which is meant to be exemplary in nature and nonlimiting except so as to be commensurate in scope with the appended claims.

I claim:

1. A portable darkroom, the combination of a box having a closed top, bottom, back, sides and a partially open front, the improvement of a light trap in the front which comprises:

A. an accessible opening in the front of said box defined by, 1. a bottom baffle extending upwardly from the bottom of said box,
2. a top baffle extending downwardly from the front edge of the top of said box in spaced apart and parallel relation to said bottom baffle and forward thereof, said top of said box extending forward of the bottom baffle and,
3. a non-reflective surface on the inside surface of said box to exclude reflections of light within said box, and, B. a non-reflective surface removably attached to the floor and wall portions adjacent to said opening to eliminate reflective light from entering said opening.

2. A portable darkroom, as defined in claim 1, in which said last-mentioned nonreflective surfaces extend sufficiently high on an adjacent wall to intercept a projected ray extending between points on the edge of said bottom and top baffles.

3. A portable darkroom, as defined in claim 1, in which said last-mentioned nonreflective surfaces extend sufficiently far along the floor so as to intercept a ray projected downwardly in a plane along the front face of said bottom baffle.

4. A portable darkroom, as defined in claim 1, in which said last-mentioned nonreflective surface extends laterally of said opening for a sufficient distance to intercept a ray projected from a point on the front edge of one side of said box and a point at the juncture of the lower baffle and the opposite side of said box.

5. A portable darkroom, as defined in claim 4, in which the point at which said ray intercepts said nonreflective surface is disposed in a plane parallel to said side of said box.

6. A portable darkroom, as defined in claim 1, in which the bottom of said box is from one-half to two-thirds the width of the top of said box as defined by the top and bottom baffles.

* * * * *